United States Patent [19]

Steinebrunner

[11] Patent Number: 4,647,113

[45] Date of Patent: Mar. 3, 1987

[54] METHOD OF REPLENISHING THE SUPPLY OF BRISTLES IN THE MAGAZINES OF BRUSH MAKING MACHINES

[75] Inventor: Walter Steinebrunner, Todtnau, Fed. Rep. of Germany

[73] Assignee: Anton Zahoransky, Todtnau, Fed. Rep. of Germany

[21] Appl. No.: 826,063

[22] Filed: Feb. 4, 1986

Related U.S. Application Data

[62] Division of Ser. No. 672,100, Nov. 15, 1984, Pat. No. 4,610,481.

[30] Foreign Application Priority Data

Nov. 29, 1983 [DE] Fed. Rep. of Germany ..... 3343071
Nov. 29, 1983 [DE] Fed. Rep. of Germany ... 8334183[U]
Jan. 21, 1984 [DE] Fed. Rep. of Germany ..... 3402050

[51] Int. Cl.[4] ..... A46D 1/04
[52] U.S. Cl. ..... 300/21
[58] Field of Search ..... 300/4, 5, 6, 7, 18, 300/19, 21

[56] References Cited

U.S. PATENT DOCUMENTS

| | | | |
|---|---|---|---|
| 1,810,645 | 6/1931 | Dieter | 198/646 X |
| 2,356,121 | 8/1944 | Cave et al. | 300/7 |
| 2,893,594 | 7/1959 | Burt et al. | 414/418 X |
| 4,111,491 | 9/1979 | Steinebrunner et al. | 300/21 |
| 4,603,913 | 8/1986 | Benno et al. | 300/7 |

*Primary Examiner*—Mark Rosenbaum
*Assistant Examiner*—Timothy V. Eley
*Attorney, Agent, or Firm*—Peter K. Kontler

[57] ABSTRACT

The magazine of a brush making machine receives batches of parallel bristles from an opening station where the batches are relieved of their envelopes. The upper end of the envelope for a batch which is delivered to the opening station in upright position is engaged by a clamping device, and the batch is thereupon lifted so that its upper end becomes exposed and is ready to be engaged by a tongs which lifts the batch to thus complete its separation from the envelope prior to transfer into the magazine.

10 Claims, 13 Drawing Figures

METHOD OF REPLENISHING THE SUPPLY OF BRISTLES IN THE MAGAZINES OF BRUSH MAKING MACHINES

This application is a division of application Ser. No. 672,100 filed Nov. 15, 1984 now U.S. Pat. No. 4,610,481.

CROSS-REFERENCE TO RELATED CASE

The method of the present invention constitutes an improvement over and a further development of the method which is disclosed in the commonly owned U.S. Pat. No. 4,111,491 granted Sept. 5, 1978 to Walter Steinebrunner et al. for "Method and apparatus for feeding bristles in brush making machines". The disclosure of this patent is incorporated herein by reference.

BACKGROUND OF THE INVENTION

The present invention relates to brush making machines in general, and more particularly to improvements in a method of replenishing the supply or supplies of bristles in the magazine or magazines of a brush making machine.

Bristles which are to be introduced into the magazines of brush making machines are normally stored in the form of packages each of which contains a batch of parallel bristles and an envelope surrounding the batch. In many instances, each package is a cylinder whose length equals or slightly exceeds the length of the confined bristles and whose envelope consists of paper, synthetic plastic material or the like.

The patent to Steinebrunner et al. discloses several types of knives which can be used as a means for opening the envelopes surrounding bundles of parallel bristles prior to introduction of the bundles into the magazine of the brush making machine. As a rule, the knife is moved in the axial direction of the confined bristles, but it is also possible to move the knife radially of the normally cylindrical package. A drawback of such mode of opening the envelopes for confined batches of bristles is that the cutting edge of the knife is likely to damage at least some of the bristles as well as that the knife is likely to shift certain bristles relative to the remaining bristles of the batch; this can present problems in connection with the transport of shifted bristles through the magazine and to the inserting station where tufts containing predetermined numbers of bristles are to be inserted into the body of a brush. Still further, the cutting edges of the knives become dull after a relatively short interval of use so that the operation of the bristle feeding apparatus, or of the entire brush making machine, must be interrupted, often for extended intervals of time, in order to allow for inspection and/or replacement of the knife which is used to slit open and/or to otherwise destroy the integrity of the envelopes around the confined batches of bristles. If a dull knife is not detected in time, its envelope-opening action may not be satisfactory and this can lead to more serious malfunctions as well as to losses of substantial quantities of bristles.

Once an envelope has become separated from the respective batch of bristles, it must be removed from the machine by additional auxiliary equipment which is rather bulky, complex and expensive. Such equipment can operate properly only if the envelope of a package is fully separated from the respective batch of bristles, i.e., its operation is dependent upon the condition of the knife which is used to slit or otherwise open the envelopes.

OBJECTS AND SUMMARY OF THE INVENTION

An object of the invention is to provide a novel and improved method of relieving packages of confined batches of brushes of their envelopes preparatory to admission of bristles into the magazine of a brush making machine.

Another object of the invention is to provide a method which can be utilized for predictable, rapid and safe removal of envelopes from short or long series of batches of parallel bristles.

A further object of the invention is to provide a method which ensures predictable removal of envelopes from successive batches of bristles in such a way that the exposed batches can be delivered into the magazine of a brush making machine at a high frequency and in optimum orientation for addition to the existing supply of bristles in the magazine.

An additional object of the invention is to provide a method which ensures gentle treatment of bristles, which does not entail any undesirable shifting or other misalignment of bristles during removal of the envelopes, and which need not involve the use of knives and/or other tools that require sharpening, other types of treatment and/or frequent inspection.

Still another object of the invention is to provide a method which can be resorted to for the manipulation of a single type of bristles or for the manipulation of two or more different types of bristles with the same degree of facility and predictability.

An additional object of the invention is to provide a method which can be used for predictable separation of envelopes from batches of parallel bristles irrespective of whether the batches are delivered with their bristles in upright position, in horizontal position or in any other orientation which is selected in order to save space and/or for other reasons.

A feature of the invention resides in the provision of a method of replenishing the supply of bristles, particularly in the magazine of a brush making machine, with batches of bristles which are supplied in envelopes, e.g., in paper wrappers or in wrappers made of a suitable synthetic plastic material and surrounding a batch of parallel bristles. The method comprises the steps of partially removing the envelopes from successive batches of bristles so that a portion of each successive batch becomes exposed, grasping the exposed portions of successive batches, and transferring successive grasped batches (e.g., into the magazine) while simultaneously holding the respective envelopes against movement with the batches. The method preferably further comprises the step of delivering successive batches and their envelopes from one or more sources of batches to an opening station in the proximity of the magazine prior to the removing step. The removing step can include mechanically engaging the envelopes of successive batches (e.g., by the claws of a suitable clamping device) and moving each engaged envelope with reference to the bristles of the respective batch and/or vice versa.

At least a portion of each grasping step preferably takes place simultaneously with the respective engaging step, i.e., the aforementioned clamping device can be arranged to engage and hold the partially removed envelope while the jaws of a tongs or another suitable grasping device grasp the exposed portion of the respective batch of parallel bristles. Alternatively, the grasping steps can alternate with the respective engaging and moving steps.

As a rule, each batch of bristles has a predetermined (e.g., substantially circular) cross-sectional outline prior to the removing step. If the dimensions of the chamber or chambers in the magazine or magazines for storage of one or more supplies of bristles are such that the batches which are freshly segregated from their envelopes cannot be readily inserted into the magazine or magazines or cannot be inserted at all, the method preferably further comprises the step of changing the cross-sectional outline of each batch not later than upon completion of the transferring step, preferably in the course of the grasping step. The step of changing the cross-sectional outlines of the batches can be carried out in one or more stages, for example, to convert a cylindrical batch into one having a rectangular, square or other polygonal outline.

The method can further comprise the step of delivering to the aforementioned opening station batches from different sources each of which contains different bristles so that the magazine (which can constitute a composite reservoir having a discrete chamber for each type of bristles) receives batches of different bristles. The delivering step can include delivering batches of different bristles in a predetermined sequence or at random, depending upon the rate at which bristles of the respective types are processed in the brush making machine.

The novel features which are considered as characteristic of the invention are set forth in particular in the appended claims. The bristle supplying apparatus itself, however, both as to its construction and its mode of operation, together with additional features and advantages of the method, will be best understood upon perusal of the following detailed description of certain specific embodiments with reference to the accompanying drawing.

DESCRIPTION OF THE PREFERRED EMBODIMENTS

Figure 1:
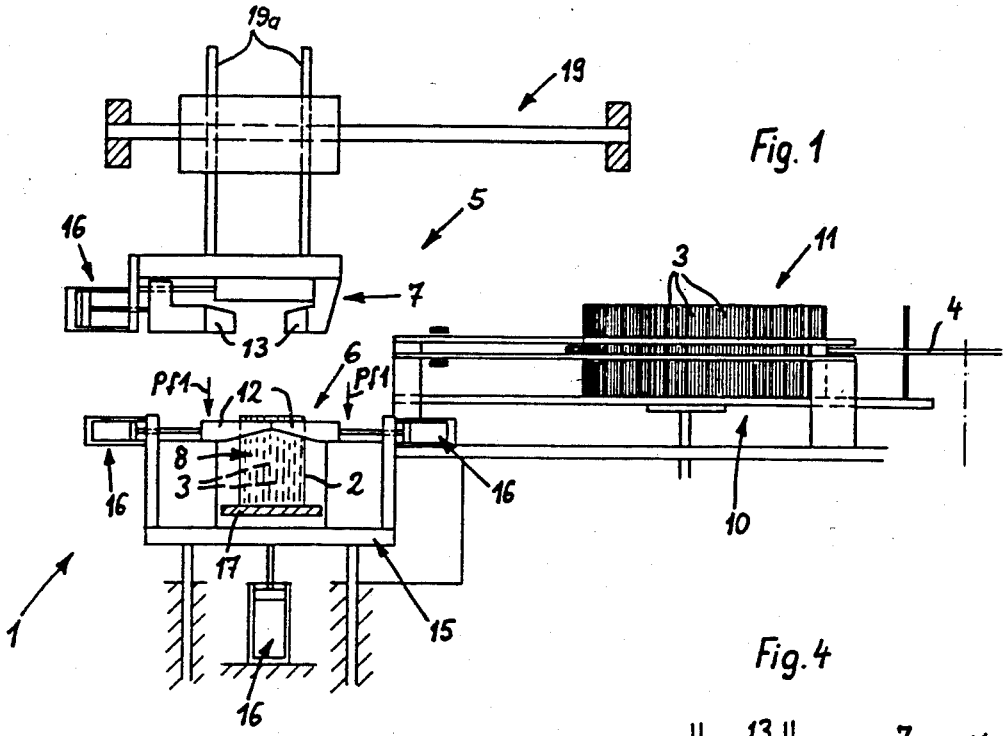
FIG. 1 is a schematic side elevational view of a first apparatus which serves to supply batches of parallel bristles from a single source to a brush making machine having a single magazine, the clamping device of the envelope removing means being shown in the operative position in engagement with a portion of the envelope at the upper end of a confined batch of parallel bristles.
Figure 4:
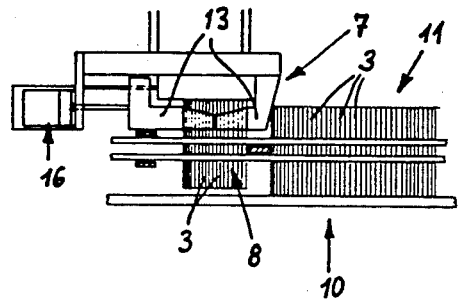
FIG. 4 shows the tongs of the grasping device in the process of depositing a fresly exposed batch of parallel bristles into the magazine of the brush making machine.

The apparatus 1 which is shown in FIG. 1 comprises an opening station 5 where the envelopes 2 for successive batches 8 of parallel bristles 3 are separated from the batches preparatory to transfer of the thus exposed batches into a magazine 10 which forms part of a brush making machine. The means for removing tufts of bristles 3 from the magazine 10 for insertion into the body of a brush comprises an oscillating transfer element 4 which is constructed, mounted and operated in a manner as disclosed in the U.S. Pat. No. 4,111,491 to Steinebrunner et al. and is shown schematically in FIGS. 1, 8 and 11.

The apparatus 1 comprises a removing unit 6 which is basically a clamping device with two reciprocable claws 12 (see particularly FIGS. 9 and 10) movable toward and away from each other to engage the envelope 2 close to the upper axial end of a cylindrical batch 8 containing a number of parallel upright bristles 3. The device 7 for grasping the exposed (non-confined) upper end portions 9 of the batches 8 upon partial removal of the respective envelopes 2 comprises a tongs with two jaws 13 one of which is movable toward the other between the open position of FIG. 1 and the closed position of FIGS. 2, 3 and 4. The tongs of the grasping device 7 further serves to move the freshly exposed (unwrapped) batches 8 of bristles 3 into the magazine 10 where such bristles are added to the supply 11 of parallel bristles in the rearmost portion of the magazine 10, i.e., in that portion which is remotest from the discharge end and the transfer element 4. In the embodiment of FIGS. 1 to 10, the tongs of the grasping device 7 comprises two jaws only one of which is movable toward and away from the other, and the clamping device 6 comprises two claws 12 each of which is movable toward and away from the other. The configuration of the concave surfaces 14 bounding the envelope-engaging sides of the claws 12 (see FIGS. 9 and 10) match the outline of the package including a batch 8 of parallel bristles 3 and the respective envelope 2, and the configuration of the concave inner sides or surfaces of the jaws 13 of the grasping device 7 matches the outline of the exposed portion 9 of the batch 8 at the opening station 5. Since the packages including the batches 8 and the corresponding envelopes 2 have a substantially circular outline (i.e., each such package is an upright cylinder), each of the concave surfaces 14 has a semicircular shape and the same applies for the concave surfaces of the jaws 13 forming part of the grasping device 7.

The clamping device 6 is installed in a movable frame or conveyor 15 which constitutes a vertically movable elevator and is movable in and counter to the direction indicated by the arrow Pfl. The means for moving the frame 15 up and down comprises a fluid-operated motor 16 in the form of a double-acting hydraulic but preferably pneumatic cylinder and piston unit. Similar motors 16 are provided to move the claws 12 of the clamping device 6 toward and away from each other, and a fourth motor 16 is provided to move the left-hand jaw 13 (as viewed in FIG. 1) of the tongs of the grasping device 7 relative to the right-hand jaw 13. If desired, each of the jaws 13 can be moved by a discrete motor 16 and the clamping device 6 can be constructed and assembled in such a way that only one of its claws 12 is movable toward and away from the other claw.

The feeding means 18 (shown in FIGS. 9 and 10) which serves to deliver wrapped batches 8 to the opening station 5 is designed to deliver batches 8 in upright position so that the bristles 3 of such batches are at least substantially vertical. The feeding means 18 includes a platform or support 17 on which the batch 8 at the opening station 5 comes to rest in such a way that the lower ends of the bristles 3 forming part of the respective batch abut against the platform 17 or that layer of the envelope 2 which is adjacent to the lower ends of the bristles.

Figure 2:
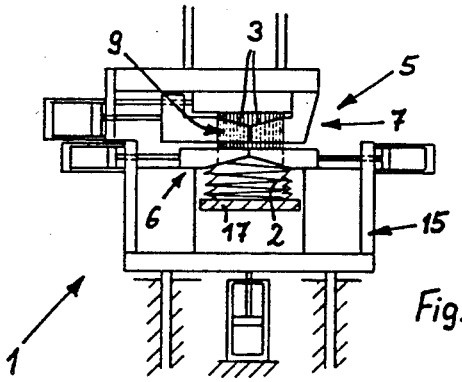
FIG. 2 illustrates a portion of the structure which is shown in FIG. 1, with the batch at the opening station partly exposed and engaged by the tongs of the grasping device.

When a freshly delivered batch 8 comes to rest on the platform 17 of the feeding means 18, the frame or elevator 15 maintains the clamping device 6 in the raised position of FIG. 1, and the motors 16 for the claws 12 are thereupon actuated to move the concave inner sides 14 of the claws into engagement with the envelope 2 close to the upper axial end of the respective batch 8. The concave surfaces 14 of the claws 12 can be roughened or otherwise treated to ensure that they can properly engage and hold the adjacent portion of the envelope 2 on the platform 17 when the motor 16 for the frame 15 is thereupon actuated to move the clamping device 6 downwardly and to thereby partially strip the envelope 2 off the respective batch 8 so that the upper end portion 9 of the batch become exposed. The distance through which the clamping device 6 is lowered from the position of FIG. 1 to the position of FIG. 2 is a fraction (e.g., one-third or one-fourth) of the axial length of the batch 8 and bristles 3 on the platform 17 of the feeding means 18. All that counts is to ensure that the exposed portion 9 of the batch 8 is large enough to allow for adequate engagement by the jaws 13 of the grasping device 7 which is thereupon actuated by starting the motor 16 for the left-hand jaw 13 of FIG. 1 in a direction to move it toward the fixed right-hand jaw 13. The movement of the left-hand jaw 13 of FIG. 1 toward the right-hand jaw 13 of the grasping device 7 is preceded by a joint movement of the jaws 13 along a horizontal guide 19 by a further fluid-operated motor (see the motor 23 in FIG. 11) to the positions which are shown in FIG. 1, namely from a level above the magazine 10 of the brush making machine to the opening station 5. In the next step, the grasping device 7 is moved upwardly along a guide **19*a* in the axial direction of the bristles 3 at the opening station 5 so that the jaws 13 of the device 7 complete the separation of the batch 8 from the respective envelope 2 which latter continues to be held by the claws 12 of the clamping device 6**.

If desired, the cylinder and piston units which constitute the motors 16 for the claws 12 can be caused to move their claws slightly apart before the grasping device 7 is moved upwardly along the guide **19*a* so as to reduce the resistance which the claws 12 and the material of the partially stripped envelope 2 offer to upward movement of the batch 8 above and away from the platform 17 of the feeding means 18. At any rate, the envelope 2 is completely separated from the respective batch 8 before the latter is inserted into the magazine 10 to constitute the rearmost portion of the supply 11 of upright bristles 3 therein. The arrangement may be such that the upward movement of the tongs of the grasping device 6 at least partially overlaps in time with the interval of time during which the claws 12 of the clamping device 6 positively hold the envelope 2 against upward movement with the batch 8. All that counts is to ensure that the batch 8 is completely separated from the respective envelope 2 before its bristles 3 are introduced into the magazine 10. If desired, the intervals during which the claws 12 positively engage and hold the envelope 2 can alternate with the interval or intervals during which the tongs of the grasping device 7 is caused to rise by moving along the guide 19*a* in order to lift the batch 8 above and away from the platform 17 preparatory to movement of the tongs along the guide 19 toward the supply 11 of parallel bristles 3 in the magazine 10**.

The guide **19*a* defines a path which is parallel to the axes of the bristles 3 on the platform 17 and the guide 19** defines a path which is at least substantially normal to the axes of such bristles.

Figure 6:
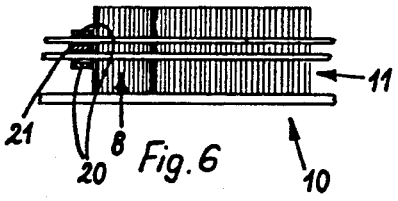
FIG. 6 illustrates the manner in which the tamping members operate to compact the bristles in the magazine of the brush making machine.
Figure 7:
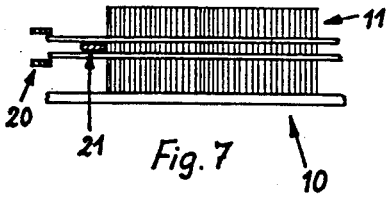
FIG. 7 shows the structure of FIG. 6 but with the tamping members in different positions relative to each other.
Figure 8:
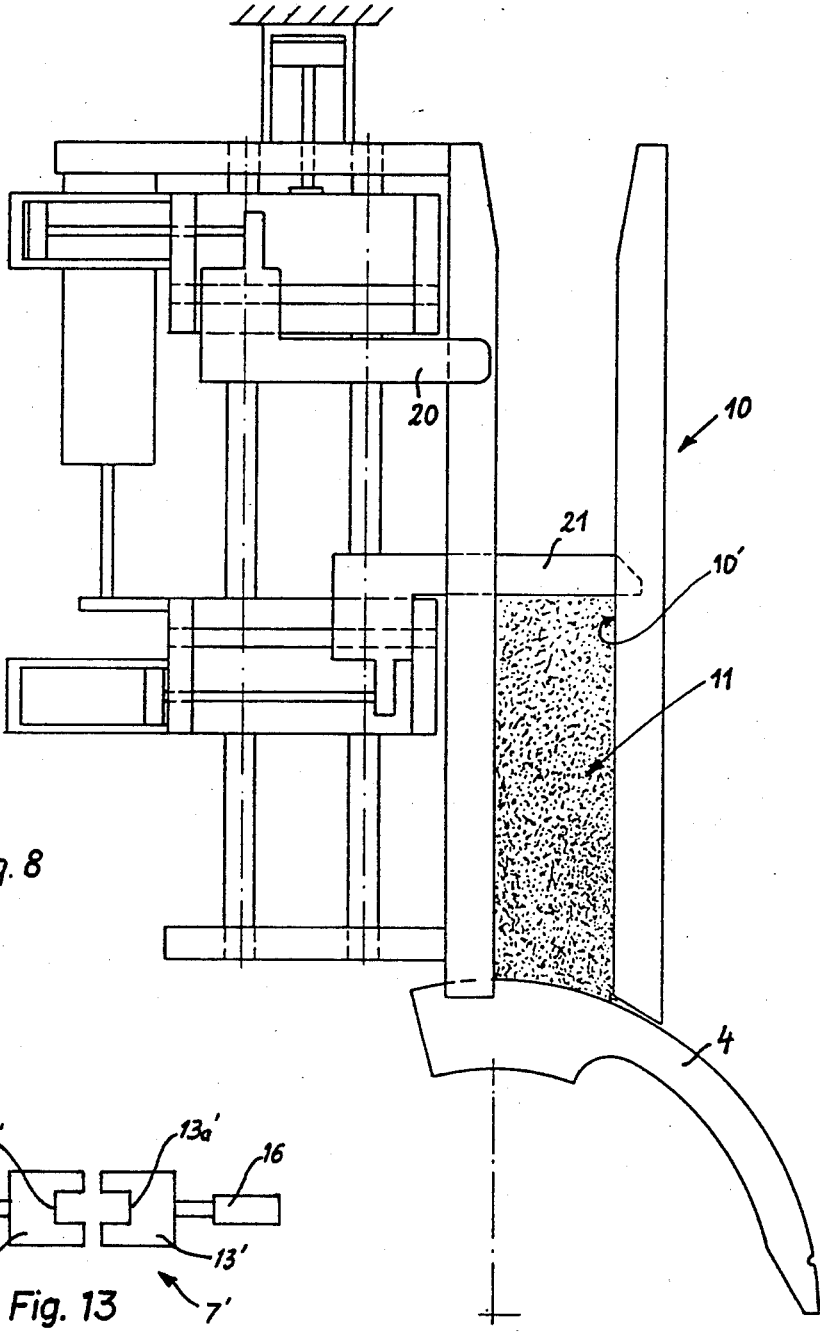
FIG. 8 is a plan view of the magazine of the brush making machine, further showing the means for cyclically moving the tamping members and an oscillating transfer element which is designed to remove tufts of bristles from the discharge end of the magazine.

As can be seen in FIGS. 6 to 8, the magazine 10 defines an elongated chamber or chute 10' for the supply 11 of bristles therein. The rear or intake end of the chamber 10' receives successive batches 8 of parallel bristles 3 from the tongs of the grasping device 7, and the front or discharge end of the supply 11 in the chamber 10' of the magazine 10 is adjacent to the aforementioned transfer element 4 which is designed to deliver tufts each of which contains a predetermined number of bristles 3 to the inserting station, namely to the station where an inserting member introduces successive tufts into the body of a brush.

The magazine 10 cooperates with two cyclically movable bristle biasing or tamping members 20 and 21 which are shown in FIGS. 6, 7 and 8 and are operated by suitable fluid-operated motors (shown in FIG. 8) in a manner as fully described in the aforementioned U.S. Pat. No. 4,111,491 to Steinebrunner et al. The arrangement is such that, when the tongs of the grasping device 7 delivers a batch 8 of parallel vertical bristles to the position of FIG. 4, the distance between the tamping or biasing members 20 and 21 suffices to allow for insertion of the batch 8 therebetween whereupon the rear tamping member (note the tamping member 20 of FIG. 8) moves into the magazine 10 and forwardly toward the transfer element 4 to urge the bristles 3 of the freshly admitted batch 8 against the rear end of the supply 11 of bristles in the magazine 10. In the illustrated magazine 10, the tamping member 20 is bifurcated and the tamping element 21 comprises a single prong at a level between the tines or prongs of the bifurcated member 20. In FIG. 6, the members 20 and 21 cooperate to bias a freshly admitted batch 8 toward the rear end of the supply 11. In FIG. 7, the member 21 is in the process of moving rearwardly and away from the member 20. In FIG. 8, the member 20 is located outside of the magazine 10 and the distance between the members 20 and 21 suffices to enable the tongs of the grasping device 7 to insert a freshly delivered batch 8 therebetween. As mentioned above, the manner in which the tamping members 20 and 21 can perform cyclical movements in the longitudinal direction of the magazine 10 as well as at right angles to such direction under the action of suitably distributed and sequentially operated motors (preferably fluid-operated motors) in a manner as shown schematically in FIG. 8 is fully described in the patent to Steinebrunner et al.

Figure 9:
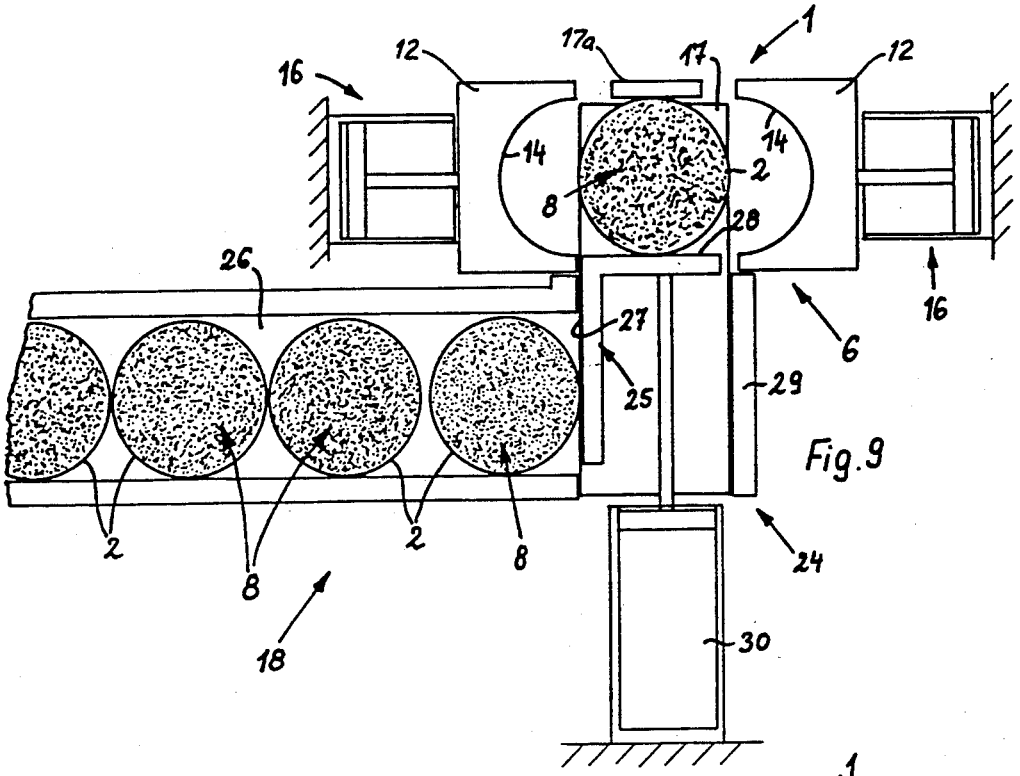
FIG. 9 is a plan view of the apparatus, further showing a singularizing device which forms part of the means for feeding discrete confined batches of parallel bristles to the opening station.
Figure 10:
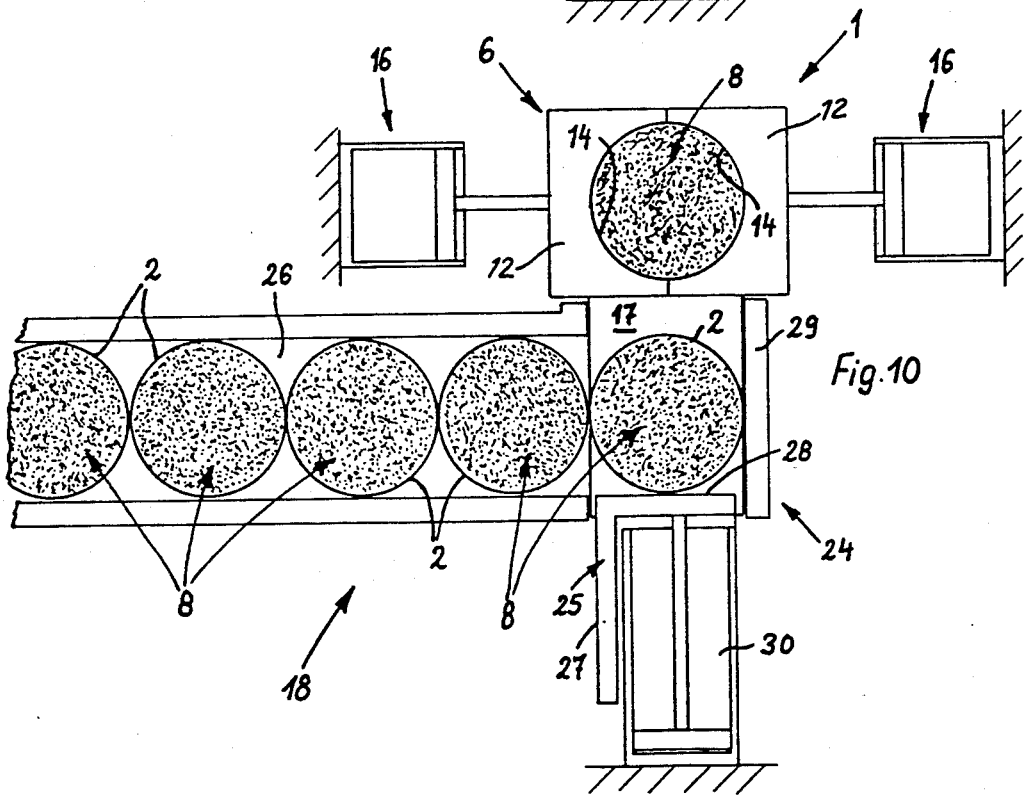
FIG. 10 shows the structure of FIG. 8 but with a reciprocable gate of the singularizing device in a different position.

The details of the feeding means 18 which delivers discrete wrapped batches 8 to the platform 17 at the opening station 5 of the apparatus 1 are shown in FIGS. 9 and 10. The feeding means 18 comprises a singularizing device 24 which is designed to deliver to the platform 17 one batch 8 at a time and comprises a substantially L-shaped gate 25 which is movable between the positions of FIGS. 9 and 10. In the position of FIG. 9, the surface 27 of the gate 25 is located in the path of forward movement of batches 8 in a source 26 here shown as a chute wherein the batches 8 can slide by gravity toward the surface 27. A fluid operated motor 30 can move the gate 25 from the position of FIG. 9 to the position of FIG. 10 in which the foremost batch 8 in the source 26 can advance into abutment with a stationary stop 29 in front of the surface 28 of the retracted gate 25. The latter is thereupon moved back to the position of FIG. 9 whereby the surface 28 transfers the foremost batch 8 onto the platform 17 where the envelope 2 on such batch is ready to be engaged by the claws 12 of the clamping device 6. The source 26 slopes downwardly toward the gate 25 and its left-hand end (as viewed in FIG. 9 or 10) receives batches 8 from a maker or from a main source of supply (not shown).

The means for evacuating stripped envelopes 2 from the opening station 5 is not specifically shown in the drawing. Such evacuating means can comprise a source of compressed air and one or more nozzles which direct compressed air against the separated envelopes 2, a funnel which is connectable to a suction generating device, a mechanical stripping device which removes the separated envelopes from the platform 17 and/or any other suitable envelope gathering and removing means.

Figure 13:
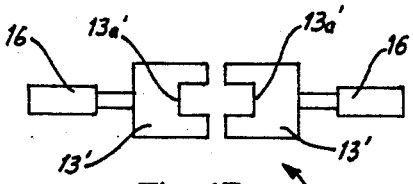
FIG. 13 is a schematic plan view of a grasping device with modified jaws.

If the width of the chamber 10' which is defined by the magazine 10 of FIG. 8 is less than the diameter of a normally cylindrical batch 8, i.e., if a batch which has been relieved of the envelope 2 cannot be readily fitted into the magazine 10 without changing its shape, the apparatus 1 further comprises means for changing the cross-sectional outline of each batch 8 prior to insertion of such batch into the chamber 10'. Such means can constitute a modified grasping device 7' which is shown in FIG. 13 and comprises two jaws 13' with internal surfaces **13*a'* defining a space or cavity of polygonal cross-sectional outline whose width and/or length matches the width of the chamber 10' in the magazine 10. It has been found that a grasping device of the type shown in FIG. 13 can readily change the cross-sectional outline of a batch 8 while the latter is being transferred into the chamber 10' of the magazine 10 so that the thus changed or converted batch can readily fit into the chamber 10' and that the density of the converted batch is not changed to any appreciable extent. In other words, the parallel bristles 3 of the batch which is engaged by the jaws 13' of the grasping device 7' are shifted in the cavity between the surfaces 13*a'*** so that the density of the resulting polygonal batch is at least substantially the same as the density of the originally cylindrical batch.

It is even possible to provide a battery of two or more gripping devices 7, 7', etc. which are arranged to transfer a batch from one to the other thereof and to gradually change the cross-sectional outline of each batch 8 from a substantially circular to a polygonal outline which latter is best suited for insertion into the chamber 10' of the magazine 10. In other words, conversion of a batch from a substantially cylindrical body into a body having a preferably polygonal shape can be carried out in a single stage (i.e., exclusively with assistance from the grasping device 7' of FIG. 13) or in two or more successive stages.

Alternatively, the claws 12 of the clamping device 6 can be used as a means for at least slightly changing the cross-sectional outline of each batch 8 during partial stripping of the respective envelope 2, and the tongs of the grasping device (such as the device 7' of FIG. 13) then complete the job of converting successive batches 8 into batches each of which has a cross-sectional outline such that it can readily fit into the chamber 10' of the magazine 10.

Figure 3:
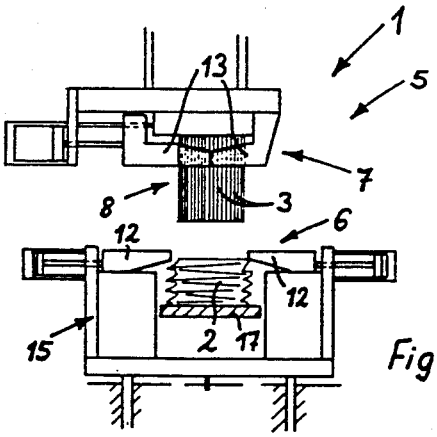
FIG. 3 illustrates the structure of FIG. 2, with the tongs lifted above the opening station to complete the extraction of the batch from its envelope which is held by the clamping device.
Figure 5:
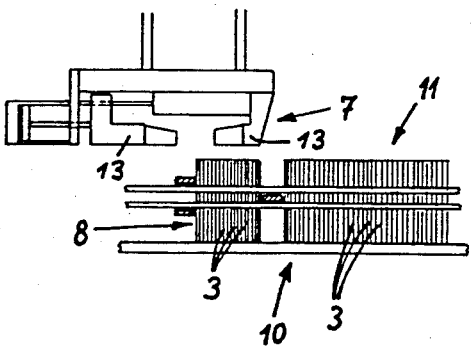
FIG. 5 illustrates the structure of FIG. 4 but with the tongs on its way back to the opening station.

As mentioned above, the claws 12 of the clamping device 6 are movable relative to each other by means of two discrete motors 16 which are shown in FIGS. 1, 2 and 3. However, it is possible to simplify the apparatus 1 by using a clamping device wherein one of the claws 12 is stationary, the same as shown for the right hand jaw 7 of FIGS. 1 to 5. Of course, it is also possible to provide the clamping device 6 with two claws only one of which is movable with reference to the other claw and to provide the grasping device 7 or 7' with two claws each of which is movable with reference to the other claw. This will depend on a number of parameters including the accuracy with which successive batches 8 are placed onto the platform 17, the force with which the claws 12 are to engage the envelope 2 of the batch 8 on the platform 17, the force with which the partially exposed batch 8 is to be lifted above and away from the platform 17 and others.

Still further, it is possible to provide the apparatus with a feeding means which delivers the batches 8 in such positions that their bristles 3 are horizontal or substantially horizontal. The platform 17 is then provided with a suitable stop (see the stop **17*a* in FIG. 9) which is located in the path of movement of the front end face of the oncoming horizontal batch 8. The orientation of the claws 12 and jaws 13 is then changed by 90 degrees so that they can properly engage the envelope 2 and the exposed portion 9 of a horizontal batch 8 on the platform 17. An advantage of the just described apparatus is that its grasping and clamping devices can be simplified without affecting the accuracy and predictability of the envelope-stripping and batch-extracting operations. For example, the platform 17 can constitute the stationary claw of the clamping device for the envelopes 2 of successive horizontal batches 8 so that such stationary claw can perform the function of one of the claws 12 as well as the function of the platform 17**.

It is equally possible to modify the apparatus which is shown in FIGS. 1 to 10 in such a way that the clamping device 6 is maintained at a fixed level and the elevator or frame 15 is used to move the platform 17 up and down with reference to the claws 13. This can obviate the need for the guide 19*a* and for a motor (not shown) which is used in the apparatus of FIGS. 1 to 10 to move the grasping device 7 up and down along the guide 19*a*. The just described mode of operation would merely involve a reversal of functions, i.e., the platform 17 would be moved by the frame 15 up and down relative to the clamping device 6 rather than the other way around.

It is further clear that the tongs of the grasping device 7 or 7' need not deliver the exposed batches 8 directly into the magazine 10 of a brush making machine. Instead, the batches which are transported by the jaws 13 or 13' of the device 7 or 7' can be admitted into a storing unit ahead of the magazine of the brush making machine so that the storing unit can be used as a main source of supply for distribution of bristles to the magazines of two or more discrete brush making machines. Regardless of whether the device 7 or 7' delivers batches 8 to the magazine of a brush making machine or to another storing unit, the novel method of relieving the packages of confined bristles of their envelopes 2 by means of the clamping device 6 in conjunction with the grasping device 7 ensures that the envelopes are removed in a simple, efficient and time-saving manner whereby the clamping device 6 does not damage, deface and/or misalign the bristles 3 which form the batches 8 so that such bristles can be readily transported through the magazine 10 and into the range of the transfer element 4. Moreover, the envelope removing means (clamping device 6) is simple, compact and inexpensive, and its operation can be readily synchronized with that of the grasping device 7 to ensure predictable separation of envelopes 2 from successive batches 8 and ready evacuation of separated envelopes from the opening station 5. The operation of the apparatus 1 is reliable irrespective of whether it is called upon to remove envelopes from a short or a long series of batches; this is of considerable importance in automated brush making machines.

Figure 11:
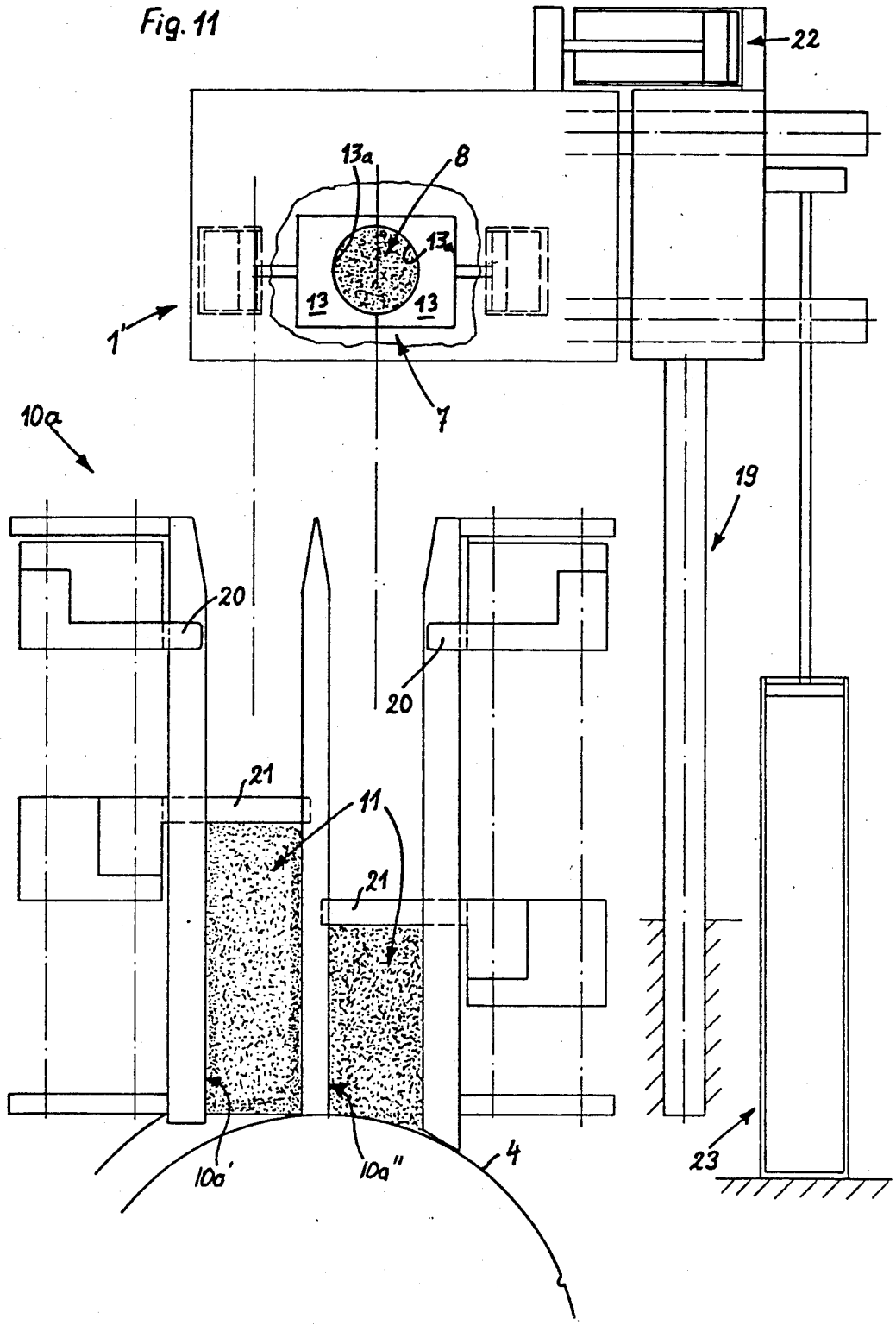
FIG. 11 is a plan view of a modified apparatus which is designed to supply different types of bristles to two discrete magazines of a brush making machine.

FIG. 11 is a plan view of an apparatus 1' which is designed to supply two types of bristles into two discrete chambers or compartments 10*a'* and 10*a''* of a modified (composite) magazine 10*a*. For example, the left-hand chamber 10*a'* of the magazine 10*a* can serve to store a supply of bristles having a first color and the right-hand chamber 10*a''* can serve to receive bristles having a different second color. The entire grasping device 7 is movable transversely of the longitudinal directions of the chambers 10*a'* and 10*a''* between a first position in which the device 7 can deliver bristles of a first color into the chamber 10*a'* and a second position in which it can deliver bristles of a second color into the chamber 10*a''*. The arrangement may be such that the tongs of the grasping device 7 alternately delivers bristles to the chambers 10*a'*, 10*a''* or that it delivers bristles of the respective color to the corresponding chambers 10*a'*, 10*a''* when the need arises, i.e., when the supply 11 of bristles in the chamber 10*a'* or 10*a''* is depleted below a permissible or acceptable value. The means for moving the grasping device 7 into register with the chamber 10*a'* or 10*a''* comprises a further fluid-operated motor 22. It will be noted that the magazine 10*a* comprises two pairs of tamping members 20, 21, one pair for each of the chambers 10*a'*, 10*a''*. The reference character 23 denotes a fluid-operated motor which is used to move the grasping device 7 along the guide 19 toward or away from the compartment 10*a'* or 10*a''* of the magazine 10*a*. The clamping device 6 is located at a level below the grasping device 7 and, therefore, it cannot be seen in FIG. 11. The reference characters 13*a* denote the concave semicircular batch-engaging surfaces of the jaws 13.

Figure 12:
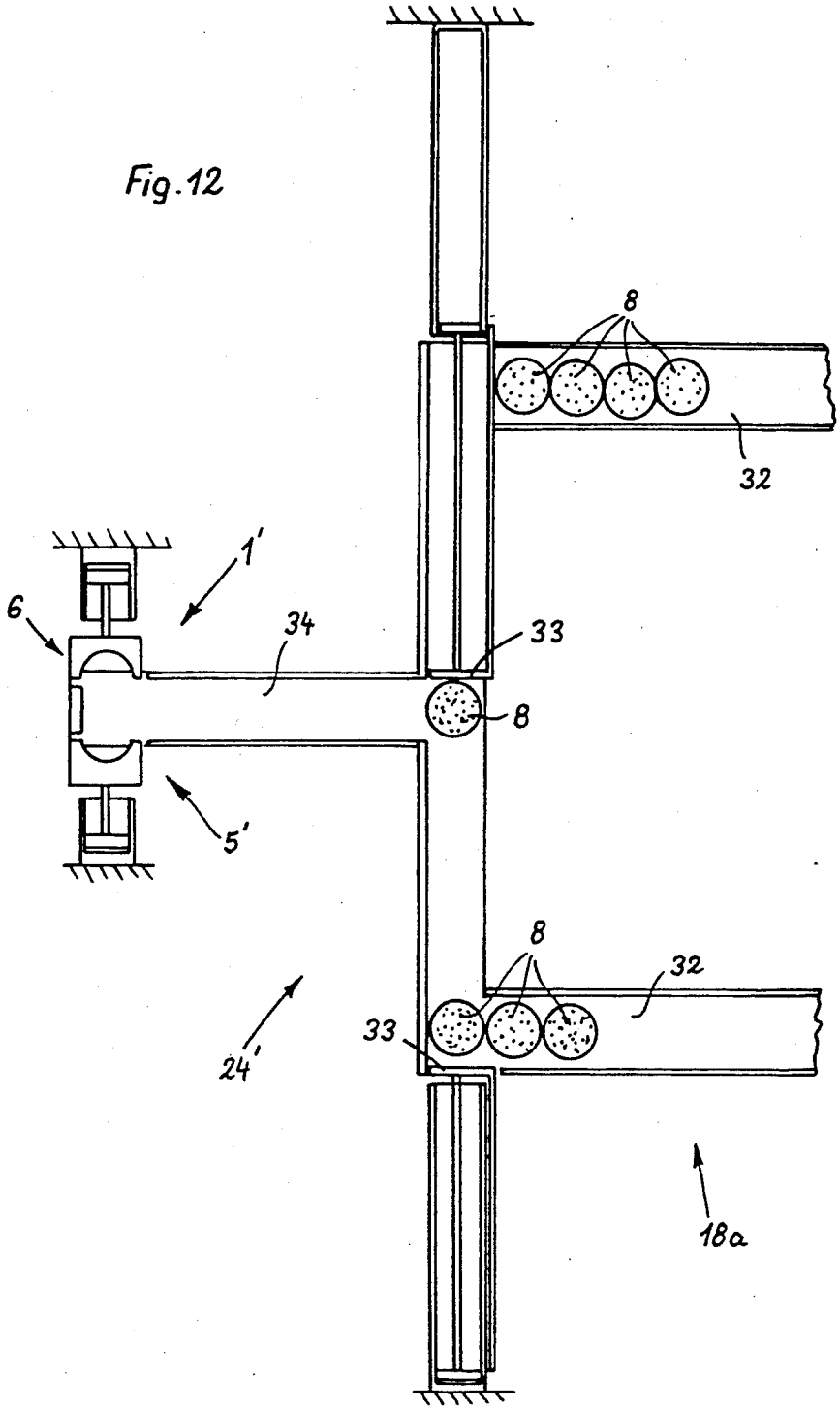
FIG. 12 is a plan view of a batch feeding system which can be used in the apparatus of FIG. 11 to deliver two different types of bristles to the opening station preparatory to delivery of batches into the respective magazines of the brush making machine.

FIG. 12 shows the details of a feeding means 18*a* which comprises two sources 32 of batches 8 each containing a different type of bristles, e.g., bristles of a different color. Such feeding means can be used to supply batches 8 in the apparatus 1' of FIG. 11. The batches 8 which are supplied by the upper source 32 of FIG. 12 can be delivered into the chamber 10*a'* and the batches 8 which are delivered from the lower source 32 of FIG. 12 are delivered into the chamber 10*a''* of the magazine 10*a* shown in FIG. 11. The bristles in the two sources 32 (each of which can constitute a chute sloping downwardly in a direction to the left, as viewed in FIG. 12) can have different colors, lengths, thicknesses, flexibilities, consistencies and/or other characteristics.

The singularizing device 24' of FIG. 12 comprises two reciprocable pushers 33, one for each of the sources 32, which can deliver batches 8 to a chute 34 leading directly to the opening station 5' of the apparatus 1' where the envelope 2 of an oncoming batch 8 is engaged by the claws of the clamping device 6. It is clear that the apparatus 1' embodying the structure of FIGS. 11 and 12 can be modified to comprise three or more discrete sources and a correspondingly modified singularizing device which can deliver to the chute 34 different batches 8 at random intervals, in a predetermined sequence or whenever the need for a particular type of bristles arise. It has been found that a single clamping device 6 normally suffices even if the apparatus receives batches of bristles from two or more different sources, and the same holds true for the tongs of the grasping device. This contributes significantly to the simplicity of such apparatus.

The exact construction of the sensors which are installed in the improved apparatus and initiate various operations in the desired sequence forms no part of the present invention. The apparatus 1 or 1' can employ mechanical sensors, optoelectrical transducers and/or other suitable monitoring means.

An important advantage of the improved method is that the bristles 3 of the bundles 8 are much less likely to be damaged than in heretofore known apparatus wherein the envelopes are opened by means of knives or the like, and also that the improved apparatus can be used without stoppage for extended periods of time because it does not employ knives or other types of tools which require frequent inspection, sharpening and/or other treatment. Moreover, the operation of the clamping device 6 can be readily synchronized with that of the grasping device 7 or 7' in such a way that the two devices ensure predictable and reliable retention of successive batches 8 in each of their starting or intermediate positions on the way of such batches to and from the opening station 5 or 5'. The maintenance cost of the apparatus which is used for the practice of the improved method is a small fraction of the maintenance cost of heretofore known apparatus wherein the envelopes are opened by knives or like tools which are prone to wear and must be inspected at frequent intervals.

The configuration of the jaws 13 or 13' can be readily selected in such a way that they can safely grip and transport the batches 8 upon separation of such batches from their envelopes, i.e., the bristles of the batches which are held by the jaws 13 or 13' are not likely to move axially and/or to otherwise change their positions in a manner which would interfere with their introduction into and/or transport through the magazine or to another storing unit.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of replenishing a supply of bristles, particularly in the magazine of a brush making machine, with batches of bristles which are supplied in envelopes, comprising the steps of partially removing the envelopes from successive batches of bristles so that a portion of each successive batch becomes exposed; grasping the exposed portions of successive batches; and transferring successive grasped batches while simultaneously holding the respective envelopes against movement with the batches.

2. The method of claim 1, further comprising the step of delivering successive batches and their envelopes to an opening station in the proximity of the magazine of a brush making machine prior to said removing step.

3. The method of claim 1, wherein said removing step comprises mechanically engaging the envelopes of successive batches and moving each engaged envelope with reference to the bristles of the respective batch or vice versa.

4. The method of claim 3, wherein each of said grasping steps alternates with the respective engaging and moving steps.

5. The method of claim 1, wherein at least a portion of said grasping step for each of the batches takes place simultaneously with the respective engaging step.

6. The method of claim 1 of replenishing the supply of bristles with batches which contain parallel bristles and each of which has a predetermined cross-sectional outline prior to said removing step, further comprising the step of changing the cross-sectional outline of each batch not later than upon completion of said transferring step.

7. The method of claim 6, wherein said changing step is carried out in several stages.

8. The method of claim 6, wherein said changing step includes changing the originally circular cross-sectional outline of each batch to a polygonal outline.

9. The method of claim 1, further comprising the step of delivering batches of different bristles to an opening station in the proximity of the magazine of a brush making machine prior to the respective removing step so that the magazine receives batches of different bristles.

10. The method of claim 9, wherein said delivering step includes delivering batches of different bristles in a predetermined sequence.

* * * * *